US005507416A

United States Patent [19]

Rapchak et al.

[11] Patent Number: 5,507,416

[45] Date of Patent: Apr. 16, 1996

[54] TAMPER EVIDENT PUSH PULL RESEALABLE CAP

[75] Inventors: Thomas P. Rapchak; Michael Marino, both of New Castle, Pa.

[73] Assignee: West Penn Plastics, New Castle, Pa.

[21] Appl. No.: 314,674

[22] Filed: Sep. 29, 1994

[51] Int. Cl.[6] ..... B67D 5/33

[52] U.S. Cl. ..... 222/153.07; 222/153.14; 222/525

[58] Field of Search ..... 222/153.07, 153.14, 222/153.06, 525, 541.6, 541.9, 568, 570; 215/253, 256

[56] References Cited

U.S. PATENT DOCUMENTS

| | | | |
|---|---|---|---|
| 4,253,588 | 3/1981 | Lester et al. | 222/525 |
| 4,500,016 | 2/1985 | Funfstuck | 222/498 |
| 4,561,553 | 12/1985 | Crisci | 215/256 |
| 4,589,561 | 5/1986 | Crisci | 215/256 |
| 4,749,103 | 6/1988 | Barriac | 222/153.14 |
| 4,760,941 | 8/1988 | Salmon et al. | 222/153.07 |
| 4,779,764 | 10/1988 | Debetencourt | 222/83 |
| 4,801,032 | 1/1989 | Crisci | 215/256 |
| 4,805,807 | 2/1989 | Perne et al. | 222/212 |
| 4,948,003 | 8/1990 | Munoz | 215/237 |
| 5,104,008 | 4/1992 | Crisci | 222/153.07 |

*Primary Examiner*—Andres Kashnikow
*Assistant Examiner*—Philippe Derakshani
*Attorney, Agent, or Firm*—Harpman & Harpman

[57] ABSTRACT

An improvement for a tamper evident resealable cap for use on a bottle, the cap having an upstanding spout that is registerable with an opening in the center of the cap and a sealing plug of a smaller diameter positioned thereabove on multiple upstanding legs extending from the spout. The improvement is directed towards a detachable annular ring secured to the cap by a plurality of frangible elements thereabout, the ring is arranged for restrictive registration with a locking shoulder that extends from the top of the cap body. The cap body has a tamper evident band secured to the cap by a plurality of circumferentially spaced frangible elements with a plurality of annularly spaced radially inwardly extending annular projections and is registerable with a neck portion of the bottle to prevent rotation in one direction without removal of the tamper evident ring.

12 Claims, 3 Drawing Sheets

TAMPER EVIDENT PUSH PULL RESEALABLE CAP

BACKGROUND OF THE INVENTION

1. Technical Field

This device relates to tamper evident closures for use on containers. This improvement relates to resealable push pull type closures that provide resealable access to the contents of a bottle with a tamper evident indication of removal of the closure.

2. Description of Prior Art

Prior art devices of this type are related to tamper evident closures, see for example U.S. Pat. Nos. 4,948,003, 5,104,008, 4,500,016, 4,561,553, 4,589,561, 4,779,764, 4,801,032, and 4,805,807.

SUMMARY OF THE INVENTION

An improvement in a tamper evident resealable closure for bottles that require a push pull pour spout cap to have a tamper indicating band as well as a second tamper indicating ring on the cap body registerable with the neck of the bottle. The improvement resides in the restriction of the tamper evident indicating band on the pour spout cap when once opened retaining the tamper evident ring on the pour spout.

DESCRIPTION OF THE PREFERRED EMBODIMENT

Figure 1:
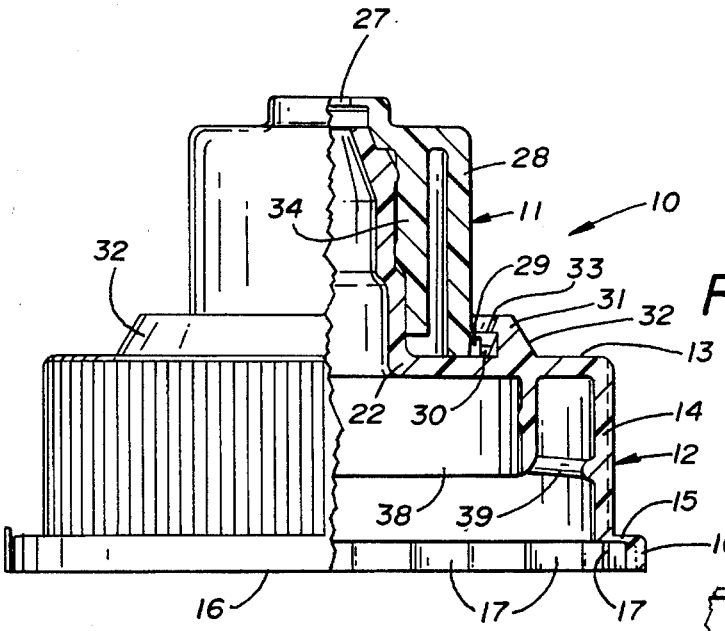
FIG. 1 is a partial cross-sectional view of a resealable bottle cap with portions broken away shown in closed position.
Figure 2:
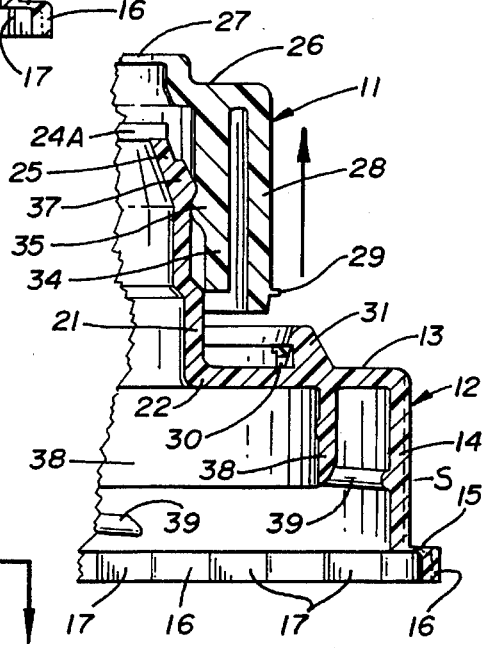
FIG. 2 is a partial cross-sectional view of a portion of the resealable bottle cap with the pour spout cap in open position.
Figure 3:
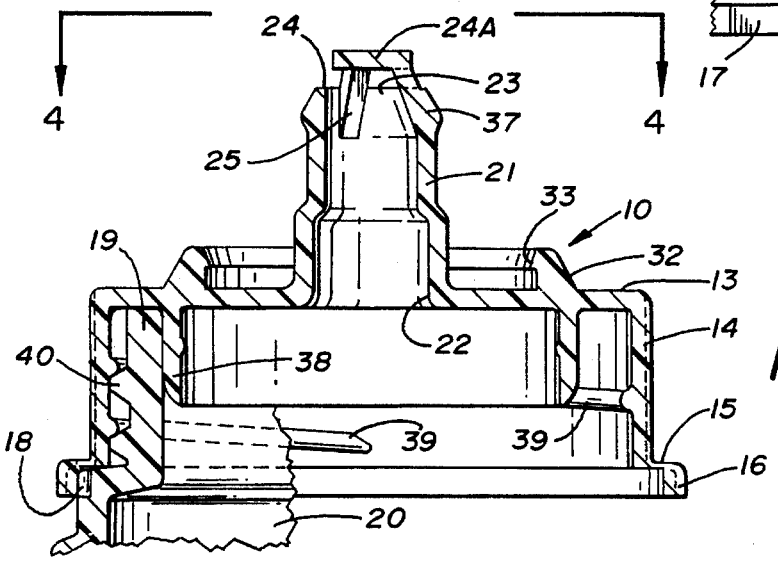
FIG. 3 is a cross-sectional view of the pour spout base of the invention.

Referring to FIGS. 1, 2 and 3 of the drawings, an improvement in a tamper evident resealable bottle cap 10 can be seen having a push pull closure 11 portion and a cap base portion 12. The cap base portion 12 comprising a top portion 13 having an downturned depending flange 14 extending therefrom defining a first tamper evident skirt S. A plurality of radially extending circumferentially spaced frangible elements 15 extend from the lower perimeter edge of the flange 14 interconnecting an annular tamper evident ring 16 thereto. The annular tamper evident ring 16 is of a larger diameter than the depending annular flange 14 having a plurality of circumferentially spaced inwardly facing projections 17, best seen in FIG. 4 of the drawings. Each of the projections 17 is angularly inclined about the inner surface of the ring 16 and are so positioned that they incline in a counter-clockwise direction for selective registration with corresponding ratchet teeth 18 extending outwardly from a neck portion 19 of a container 20 shown in FIG. 3 of the drawings as will be discussed in greater detail later.

Referring again to FIGS. 1, 2, and 3 of the drawings, it will be seen that the top portion 13 has an upstanding cylindrical pour spout 21 extending from the center thereof. An opening 22 is formed in the center of the top portion 13 in registration with the cylindrical pour spout 21. Apertures are formed at 23 within the upper end of the pour spout 21 defining a secondary top portion 24. A closure plug 24A is positioned on the secondary top portion 24 in spaced relation above the apertures 23 by a plurality of circumferentially spaced upwardly and angularly extending legs 25.

The improvement comprises the push pull top cap 11 positioned on the cylindrical pour spout 21 having a top portion 26 with a central opening 27 therein which registers with the closure plug 24A forming a secondary closure when the top cap 11 is in closed position, best seen in FIG. 1 of the drawings. The top cap 11, when in closed position, rests on the top portion 13 of the cap base portion 12. The top cap 11 has a first depending annular body flange 28 having a plurality of annularly spaced frangible elements 29 extending from its lower perimeter edge interconnecting a secondary tamper indicating ring 30. The secondary tamper evident ring 30 is of a larger diameter than that of the first annularly depending closure body flange 28 and rests on the top portion 13 as hereinbefore described. An upstanding segmented retaining flange 31 extends from and is integral with the top portion 13 centrally thereabout and in spaced relation to the upstanding pour spout 20. The segmented retaining flange 31 has a tapered outer surface 32 and an inwardly extending locking flange 33 registerable over the hereinbefore described secondary tapered tamper evident ring 30, best seen in FIG. 7 of the drawings. The top cap 11 has a second depending annular flange 34 depending from the top portion 26 inwardly of said first depending annular body flange 28. The second flange 34 has a single inturned annular flange 35 which defines a transition area of decreased transverse dimension at 36 upwardly therefrom. The cylindrical pour spout 21 has an outwardly extending annular flange 37 adjacent to its free upper end which slideably engages the inner surface of the secondary depending annular flange 34 above the single internal annular flange 35.

Figure 7:
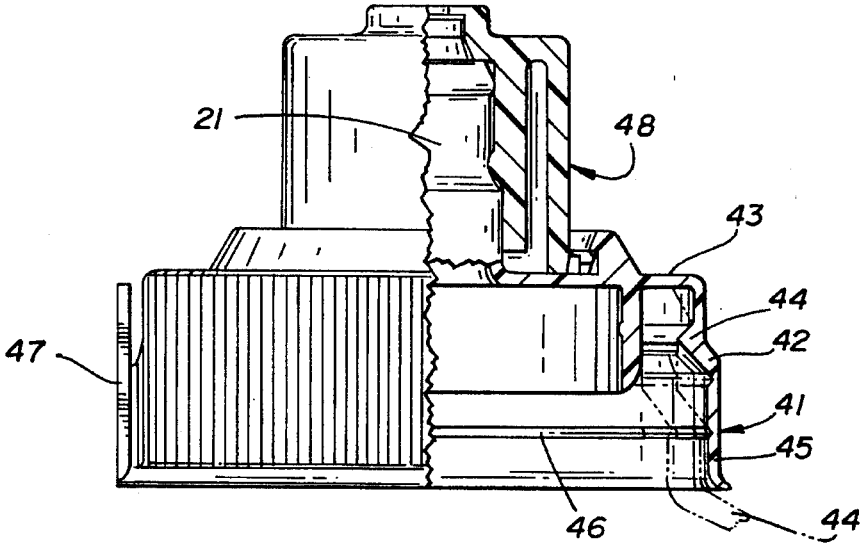
FIG. 7 is a partial cross-sectional view of an alternate form of the resealable cap of the invention showing a different tamper evident base.

In assembled form, illustrated in FIGS. 1, 2 and 7 of the drawings with the secondary tamper evident ring 30 interconnected to the top cap 11 by the frangible elements 29 so that the top cap 11 cannot be moved upwardly on the pour spout 21 due to the registration of the tamper evident ring 30 with the retaining flange 31 thus restricting the vertical movement of the cap 11 as is necessary to move the center opening 27 thereabove the plug 24A which is required for apertured clearance until sufficient force is imparted to the top cap 11 to break the frangible elements 29. With the top cap 11 free of the tamper evident ring 30 it can move upwardly on the pour spout 21 away from the plug 24A. The tamper evident ring 30 remains under the segmented retaining flange 31 on the top portion 13 of the cap base portion 12. The top cap 11 cannot move beyond the pour spout 20 due to the registration of the restricting top cap's internal annular flange 35 as hereinbefore described with the pour spout's outwardly extending annular flange 37 as best seen in FIG. 2 of the drawings.

Figure 4:
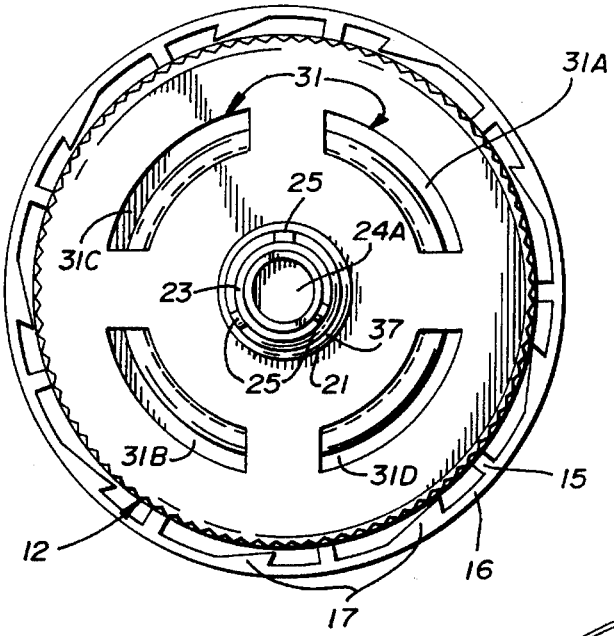
FIG. 4 is a top plan view of the pour spout base on lines 4—4 of FIG. 3.
Figure 8:
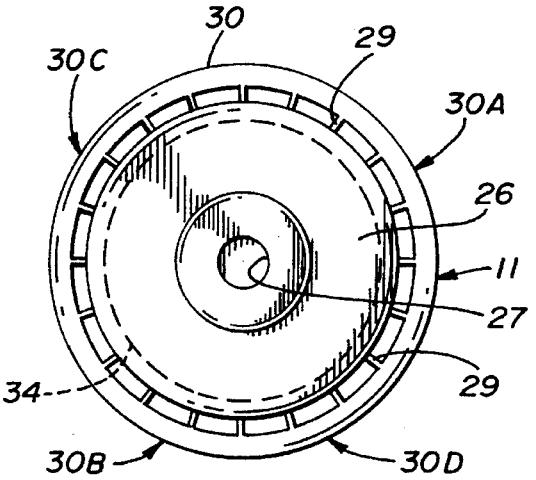
FIG. 8 is a top plan view on lines 8—8 of FIG. 6.

Referring to FIG. 4 of the drawings, the segmented retaining flange 31 can best be seen wherein the flange 31 is divided into four oppositely disposed arcuate sections 31A, 31B, 31C and 31D so as to equally register with corresponding segments 30A, 30B, 30C, and 30D of the secondary tamper evident ring illustrated in FIG. 8 of the drawings. Referring to FIG. 3 of the drawings, the cap base portion 12 has an annular sealing flange 38 depending therefrom inwardly from its top portion 13 opposite the inturned annularly depending flange 14.

A single spiral thread 39 extends from the inner surface of the integral depending annular flange 14 beginning opposite the annular sealing flange 38 just below the top portion 13 and terminating above the tamper indicating ring 16 as will be well known and understood by those skilled in the art.

The spiral thread 39 is in registering cooperation with a spiral thread 40 on the exterior of the bottle neck 19 shown in FIG. 3 of the drawings.

Referring now to FIG. 7 of the drawings, an alternate cap form of the invention can be seen defining a snap-on tamper evident base portion 41 having an annular flange 42 depending from a top portion 43. The annular depending flange 42 has an inturned annular retaining bead 44 extending therefrom in spaced relation to the top portion 13 for registration onto an alternate bottle neck configuration 44A shown in broken lines.

The alternate cap form has a tear band 45 extending from the annular depending flange 42 defined therefrom by a frangible tear line 46 of reduced transverse dimension as is typical in the art.

A tear tab 47 extends from the tear band 45 providing a removal point that in operation can be selectively engaged by the user for removal of the tear band 45, if desired and to provide indication of tampering of the container on which the alternate cap is secured.

A push pull closure 48 configuration is formed within the alternate cap and is identical to the top cap 11 and pour spout 21 configurations hereinbefore described and illustrated in FIGS. 1–4 and 6 and 8 of the drawings.

Figure 5:
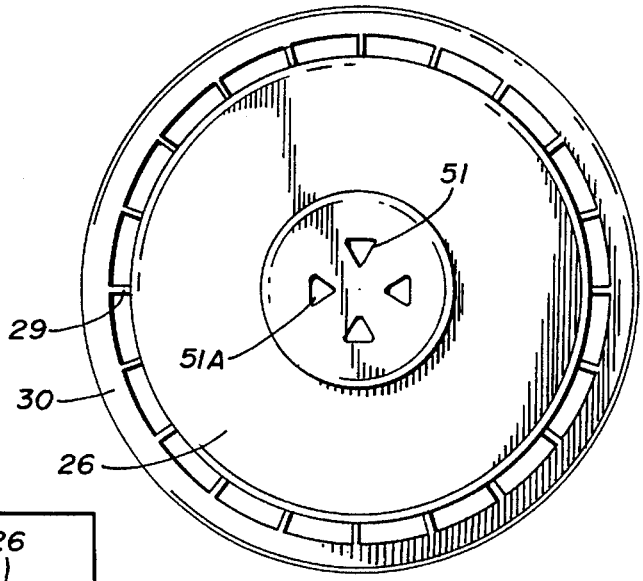
FIG. 5 is a modified top plan view of an alternate opening configuration.
Figure 6:
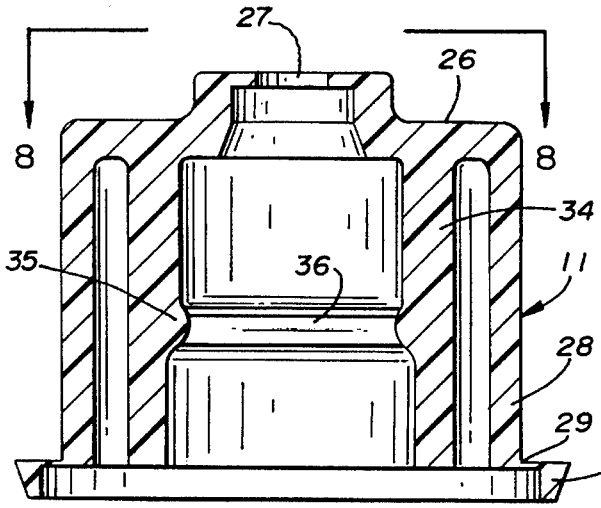
FIG. 6 is a cross-sectional view of the cap portion of the pour spout.
Figure 9:
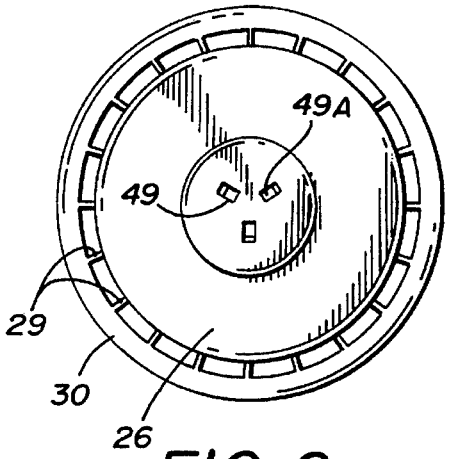
FIG. 9 is a top plan view of an alternate pour spout opening.
Figure 10:
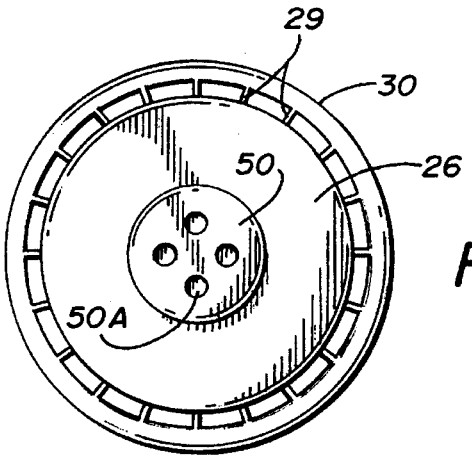
FIG. 10 is a top plan view of an alternate pour spout opening.

Referring now to FIGS. 5, 9, and 10 of the drawings, alternate top cap opening configurations are illustrated showing three apertured triangle configurations 49 in FIG. 9 and four apertured circular configurations at 50 in FIG. 10 and a modified triangular aperture at 51 in FIG. 5.

It will be evident to those skilled in the art that the alternate opening configurations illustrated in FIGS. 5, 9, and 10 are all sealable by respective registering plug configurations 49A, 50A and 51A and that the remaining elements of the alternate top cap associated with the alternate opening configurations are identical to that illustrated and described in the preferred embodiment as shown in FIGS. 1–4 and 6–8 of the drawings.

It will thus be seen that an improvement to a push pull resealable tamper evident closure has been illustrated and described and it will be apparent to those skilled in the art that various changes and modifications may be made thereto without departing from the spirit of the invention.

Therefore I claim:

1. An improvement in a tamper evident resilient resealable molded plastic bottle cap for a bottle having a neck surrounding an opening, said neck having a spiral thread thereabout, a cap having a top portion, a depending annular flange extending from said top portion, a spiral thread in said annular depending portion, an annular sealing flange depending from said top portion in spaced relation to said depending annular flange, a tamper evident band extending from a plurality of annularly spaced frangible elements on the depending annular flange, circumferentially spaced radially inwardly extending angular projections on said tamper evident band facing said bottle neck, said neck having ratchet sections registerable with said angular projections on said tamper evident band, an integral spout on said top portion in communication with an opening in said top portion, an aperture in said spout registerable with a secondary movable top cap on said spout, a plug extending from said spout above said opening registerable with an opening in said secondary top cap defining a closure when said top cap is moved in a first position, the improvement comprises a tamper evident ring having a plurality of frangible elements connecting said ring to said top cap of said cap in said first position, an upstanding retaining flange on said top portion in spaced relation to said pour spout retaining said tamper evident ring thereunder when said top cap is in said first position when said top cap is moved away from said first position to a second position said opening in said top cap in spaced relation to said plug.

2. The improvement in a tamper evident resilient molded plastic bottle cap of claim 1 wherein said upstanding retaining flange on said top portion of said cap includes a tapered outer surface, an inwardly extending locking flange on said retaining flange opposite said tapered outer surface, said locking flange in spaced relation to said top portion of said cap.

3. The improvement in a tamper evident molded plastic bottle cap of claim 1 wherein said upstanding retaining flange on said top portion of said cap is segmented into oppositely disposed pairs of annularly spaced arcuate sections.

4. The improvement in a resilient molded plastic resealable bottle cap of claim 1 wherein said top cap has a first depending closure body flange in spaced relation to said spout, with said frangible elements extending radially therefrom, said ring secured to said elements in spaced relation to said first depending portion.

5. The improvement in a resilient molded plastic resealable bottle cap of claim 1 wherein said top cap has a second depending annular flange slideably engaged on said spout.

6. The improvement in a resilient molded plastic resealable bottle cap of claim 3 wherein said spout has a tubular body of a known outer diameter and said second depending annular flange of said top cap has an inner diameter of which is greater than said known outer diameter of said tubular body.

7. An improvement in a tamper evident resilient resealable molded plastic bottle cap for a bottle having a neck surrounding an opening, said neck having a pair of vertically spaced annular flanges extending therefrom, the cap having a top portion, a depending annular flange extending from said top portion, an annular retaining bead extending inwardly from said depending annular flange in spaced relation to said top portion, an annular flange depending from said top portion in spaced relation to said depending annular flange, and a tear band extending from said depending annular flange having a tear tab integral therewith, an integral spout on said top portion in communication with an opening in said top portion, an aperture in said spout with a secondary movable top cap positioned thereon, a plug extending from said spout above said opening registerable with an opening in said secondary top cap defining a closure when said top cap is in first position, the improvement comprises a tamper evident ring having a plurality of frangible elements connecting said ring to said top cap of said cap in said first position, an upstanding retaining flange on said top portion in spaced relation to said pour spout retaining said tamper evident ring thereunder when said top cap is in said first position when said top cap is moved away from said first position to a second position positioning said opening in said top cap in spaced relation to said plug.

8. The improvement in a tamper evident resilient molded plastic bottle cap of claim 7 wherein said upstanding retaining flange on said top portion of said cap includes a tapered outer surface, an inwardly extending locking flange on said retaining flange opposite said tapered outer surface, said locking flange in spaced relation to said top portion of said cap.

9. The improvement in a tamper evident molded plastic bottle cap of claim 7 wherein said upstanding retaining flange on said top portion of said cap is segmented into oppositely disposed pairs of annularly spaced arcuate sections.

10. The improvement in a resilient molded plastic resealable bottle cap of claim 7 wherein said top cap has a first depending closure body flange in spaced relation to said spout, with said frangible elements extending radially therefrom, said ring secured to said elements in spaced relation to said first depending portion.

11. The improvement in a resilient molded plastic resealable bottle cap of claim 7 wherein said top cap has a second depending annular flange slideably engaged on said spout.

12. The improvement in a resilient molded plastic resealable bottle cap of claim 7 wherein said spout has a tubular body of a known outer diameter and said second depending annular flange of said top cap has an inner diameter of which is greater than said known outer diameter of said tubular body.

* * * * *